US006990910B2

(12) United States Patent
Kettler et al.

(10) Patent No.: US 6,990,910 B2
(45) Date of Patent: Jan. 31, 2006

(54) TABLE TENNIS TABLE

(75) Inventors: Joachim Kettler, Ense (DE); Heinz Kettler, Ense (DE); Reinhard Rocholl, Soest (DE)

(73) Assignee: Heinz Kettler GmbH & Co. KG, Ense (DE)

( * ) Notice: Subject to any disclaimer, the term of this patent is extended or adjusted under 35 U.S.C. 154(b) by 66 days.

(21) Appl. No.: 10/484,445

(22) PCT Filed: Jun. 17, 2002

(86) PCT No.: PCT/DE02/02198

§ 371 (c)(1),
(2), (4) Date: Jan. 29, 2004

(87) PCT Pub. No.: WO03/026461

PCT Pub. Date: Apr. 3, 2003

(65) Prior Publication Data

US 2004/0216649 A1 Nov. 4, 2004

(30) Foreign Application Priority Data

Aug. 31, 2001 (DE) ..... 201 14 288 U
Nov. 8, 2001 (DE) ..... 201 18 182 U

(51) Int. Cl.
*A47B 3/00* (2006.01)

(52) U.S. Cl. ..... 108/115; 108/167

(58) Field of Classification Search ..... 108/115, 108/166, 167, 168, 169, 170, 171, 172, 173, 108/174, 175; 248/188; 473/496
See application file for complete search history.

(56) References Cited

U.S. PATENT DOCUMENTS

| | | | | | |
|---|---|---|---|---|---|
| 2,911,217 | A * | 11/1959 | Block et al. | ..... | 108/167 |
| 3,190,649 | A * | 6/1965 | Heisler | ..... | 473/496 |
| 3,823,938 | A * | 7/1974 | Unno | ..... | 473/496 |
| 3,830,495 | A * | 8/1974 | Hill | ..... | 473/496 |
| 4,089,522 | A * | 5/1978 | Rock | ..... | 108/173 |
| 5,020,799 | A * | 6/1991 | Chang | ..... | 473/496 |
| 5,392,718 | A * | 2/1995 | Stevens | ..... | 108/167 |
| 5,733,211 | A * | 3/1998 | Dupre | ..... | 473/496 |
| 6,425,835 | B1 * | 7/2002 | Kettler | ..... | 473/496 |

FOREIGN PATENT DOCUMENTS

| | | |
|---|---|---|
| AU | A1-69 996/81 | 4/1981 |
| DE | 299 01 458 U1 | 1/1999 |
| FR | 2 351 624 | 5/1976 |
| FR | 2 729 302 | 1/1995 |
| GB | 1 489 795 | 6/1975 |

* cited by examiner

*Primary Examiner*—José V. Chen
(74) *Attorney, Agent, or Firm*—Hoffman, Wasson & Gitler, PC

(57) ABSTRACT

The disclosure relates to a table tennis table comprising a lower frame and two playing surface boards. Said lower frame comprises vertical struts which are used as carrier elements and are arranged opposite each other along the width of the table tennis table, in the central region of the same, and vertical guiding structure on which guiding elements pertaining to fixing units applied to the playing surface boards can be moved upwards and downwards, in such a way that the playing surface boars can thus be transferred from a first position, in which the playing surface boards are vertically oriented and the guiding elements are arranged in a lower position, to a second position, in which the playing surface boards are horizontally oriented and the guiding elements are arranged in an upper position, the guiding structure being embodied on the vertical struts used as carrier elements.

19 Claims, 5 Drawing Sheets

TABLE TENNIS TABLE

FIELD OF THE INVENTION

This invention relates to a table tennis table comprising a lower frame and two playing surface boards, the lower frame comprises vertical braces which are used as support elements and lie opposite one another over the width of the tennis table, in the middle area of the table tennis table, and vertical guide means on which guide parts pertaining to mounting units which are attached to the playing surface boards can be moved up and down so that in this way the playing surface boards can be transferred from a first position in which the playing surface boards are vertically aligned and the guide parts are located in the lower position, into a second position in which the playing surface boards are horizontally aligned and the guide parts are located in an upper position.

BACKGROUND OF THE INVENTION

A table tennis table of the aforementioned type is known from DE 299 01 458 U1. The table tennis table described in it can be moved out of a transport position in which the playing surface boards are vertically aligned into the playing position by folding the playing surface boards out of the vertical position into the horizontal position. Furthermore, the table tennis table has roller base units which are located in the middle area and with which the table tennis table can be easily transported in the transport position. In addition, this table tennis table also has static braces which can be folded out, which are encompassed by the lower frame, and which can additionally be supported by transverse braces.

In table tennis tables from the prior art it has been found to be disadvantageous that the vertical guide means are made as vertical guide tubes which are made separately. This construction is relatively complex and in terms of production engineering is associated with the corresponding costs.

The object of this invention is to devise a table tennis table of the initially mentioned type which has a simpler structure and which can be more economically produced.

This is achieved as claimed in the invention by the guide means being made on the vertical braces which are used as support elements. Separate guide tubes can be saved by this measure.

SUMMARY OF THE INVENTION

Here the vertical braces can have an essentially U-shaped or C-shaped cross section. The U-profile or C-profile of the vertical braces can be produced for example as a simple bent sheet metal part so that the manufacture of vertical braces is made extremely economical. Furthermore, the inside movable parts of the vertical guides can be covered to the outside toward the user by the U-profile or C-profiles of the connecting braces so that on the one hand there is greater safety in operation and on the other an extremely attractive appearance can be accomplished.

In particular the cross section of the vertical braces can each have a U-shaped leg and an outer leg which extends essentially vertically away from it, and the outer legs on their ends facing away from the U-shaped leg can have a turned edge. Here the turned edge can extend leg vertically away from the respective outer leg. The turned edges can extend from the outer legs away from one another or toward one another.

As claimed in the invention, it is furthermore provided that the guide part has at least one contact section which adjoins one of the side surfaces of one of the outer legs. The construction as claimed in the invention on the one hand offers the advantage that based on the U-shaped or C-shaped configuration of the vertical braces sufficient stability is ensured. On the other hand, the outer legs of the vertical braces can be used as contact surfaces for the corresponding contact sections of the guide parts.

According to one preferred embodiment of this invention, the guide parts can each have two contact sections which adjoin the opposing side surfaces of one of the outer legs. In this way reliable vertical guidance of the guide parts is achieved.

Advantageously, the guide part can encompass the turned edge of the corresponding outer leg. This results in that even under a strong external load the dynamic connection between the guide part and the outer leg of the guide part cannot be pulled off from the outer leg. In this way it can be ensured that even in a case of improper handing of the folding mechanism of the table tennis table the guide part cannot be pulled off the corresponding outer leg of the vertical brace.

It can be provided as claimed in the invention that one guide part of one mounting unit at a time can engage each of the outer legs of the two vertical braces. Furthermore, the mounting units can each comprise one attachment part which is mounted on the bottom of one of the playing surface boards.

Preferably the vertical braces are each mounted on a connecting brace which can connect to one another the individual roller base units which are located next to one another.

Advantageously it can be provided that the table tennis table on the inside of each of the vertical braces in its lower area has a support means on which the inside end faces of the playing surface boards can be supported in their vertical positions, the support means being made preferably as a support angle which is attached to the vertical brace. This supporting means results in that when a force is applied from overhead to the playing surface board which is in the vertical position or the playing surface boards which are in the vertical position, it is not the guide mechanism, i.e. especially not the mounting units with the guide part, but the support means which is loaded so that damage to the guide mechanism can be for the most part prevented by the support means.

According to one preferred embodiment of this invention it is possible for the table tennis table to comprise furthermore on each of the vertical braces two upper and two lower safety levers which are pivotally located on the vertical braces and have locking surfaces which in the first position of the safety levers enable the guide part or parts to be moved up and/or down and which in the second position of the safety levers prevent the guide parts from moving up and/or down. The safety levers can prevent the table tennis table which is in the vertical position from being folded unintentionally out of this position or a table tennis table which is in the horizontal position from being unintentionally folded up.

Preferably it can be provided that on the upper safety levers there are actuating levers for swivelling the safety levers, the upper safety levers and the lower safety levers being connected to one another so that swivelling motion of the upper safety levers causes a corresponding swivelling motion of the lower safety levers, the connection between the respective upper and lower safety levers preferably taking place via a transmission rod which is aligned essentially vertically. By connecting the upper and the lower safety levers the lower actuating levers can be saved so that the user, especially by actuating the more ergonomically arranged upper actuating lever, can also fold the playing surface boards out of the vertical position into the horizontal position.

Advantageously it can furthermore be provided that the upper safety levers are connected to one another on each of the vertical braces by a spring means so that when the actuating lever is not actuated the spring means swivels the upper safety means into the position in which the locking surfaces prevent the guide parts from moving up and down. By providing these spring means the operating safety of the table tennis table as claimed in the invention is further increased because when the actuating lever is not actuated the table tennis table is automatically in the state in which the playing surface boards cannot be folded.

BRIEF DESCRIPTION OF THE DRAWINGS

Other features and advantages of this invention become apparent based on the following description of preferred embodiments with reference to the attached figures.

DETAILED DESCRIPTION OF THE INVENTION

Figure 1:
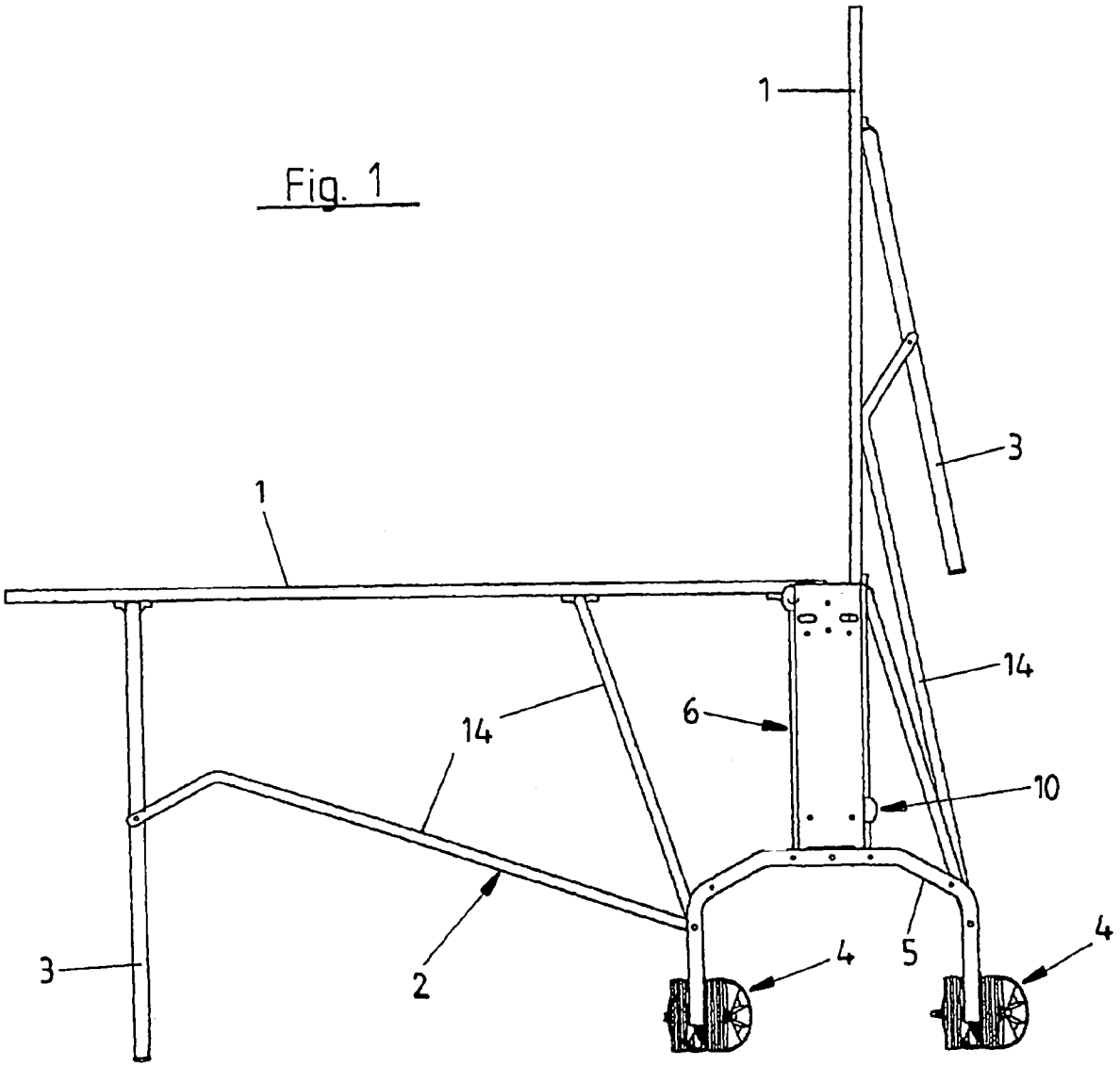
FIG. 1 shows a side view of one embodiment of a table tennis table as claimed in the invention with playing surface boards which have been folded up on one side.

As is apparent from FIG. 1, the table tennis table as claimed in the invention comprises two playing surface boards 1 which can consist for example of wood, aluminum or plastic and which can be folded up separately from one another. The playing surface boards 1 are held by means of a lower frame 2 which is encompassed likewise by the table tennis table as claimed in the invention either for transport or are supported in the horizontal position for playing.

The lower frame 2 comprises on the one hand in its outer areas, i.e. on the end faces of the playing surface boards 1, vertical static braces 3 and furthermore roughly in the middle area four roller base units 4 which each consist of two wheels and are each connected in pairs to a connecting brace 5 which extends from the roller base units 4 a distance up and then which runs horizontally. The lower frame 2 thus comprises two connecting braces 5 which are located roughly in the middle on the opposing sides of the table tennis table. From the connecting braces 5 two vertical braces 6 extend upward and support the playing surface boards 1 in the middle area of the table tennis table in the position of use in the manner which is detailed below.

To better stabilize the playing surface boards 1, the lower frame 2 furthermore comprises in the conventional manner transverse braces 14 which are coupled to the connecting braces 5, the static braces 3 and the bottoms of the playing surface boards 1.

Figure 3:
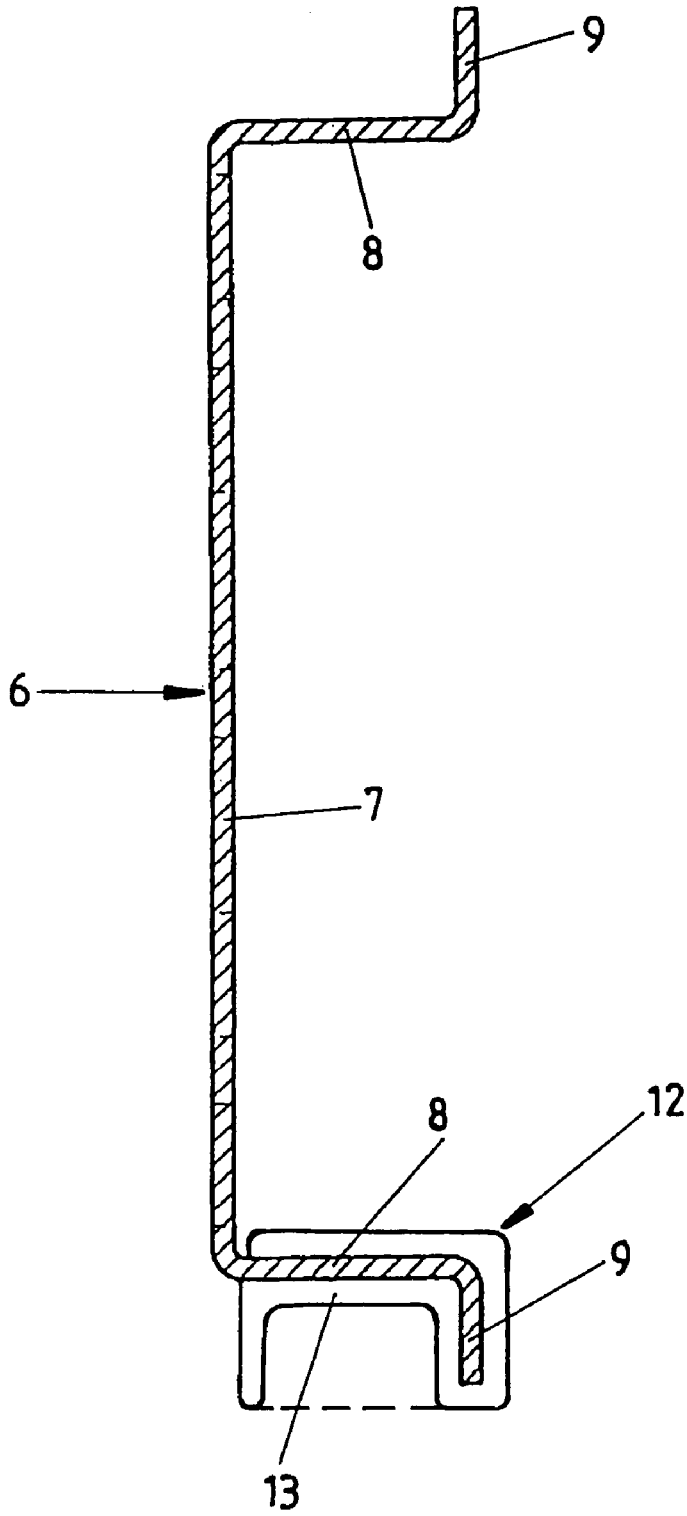
FIG. 3 shows a schematic cross section through a vertical brace of the table tennis table as shown in FIG. 1.

FIG. 3 shows the vertical brace 6 in a section. The vertical brace 6 has essentially a U-shaped or a C-shaped cross section with a middle U-shaped leg 7 which passes on its two ends into the outer legs 8 which extend essentially vertically away from the U-shaped leg 7 and to the inside in the direction to the opposing vertical brace 6. The outer legs 8 on their ends facing away from the U-shaped leg 7 have a turned edge 9 which extends essentially vertically away from the outer legs 5 and in the installation position of the vertical brace 6 to the outside, i.e. to the end faces of the playing surface boards 1. But as claimed in the invention it is also quite possible for the turned edge 9 to extend to the inside so that the two turned edges 9 extend toward one another.

The guided mounting units 10 interact with this essentially U-shaped or C-shaped vertical brace 6, of which units two at a time are located in the area of the lower inner sides of the playing surface boards 1 facing one another. The mounting units 10 on the one hand comprise an attachment part 11 which is screwed for example under the playing surface board 1. On the other hand, the mounting units 10 comprise a guide part 12 which each extends around one of the outer legs 8 together with the turned edge 9 which is located on it. In particular, the guide part 12 has two contact sections 13 which adjoin the sides of the corresponding outer legs 8, which sides lie opposite one another. Based on the fact that the turned edge 9 is surrounded by the guide part 12 at the same time, the mounting unit 10 is reliably attached to the vertical brace 6.

Figure 2:
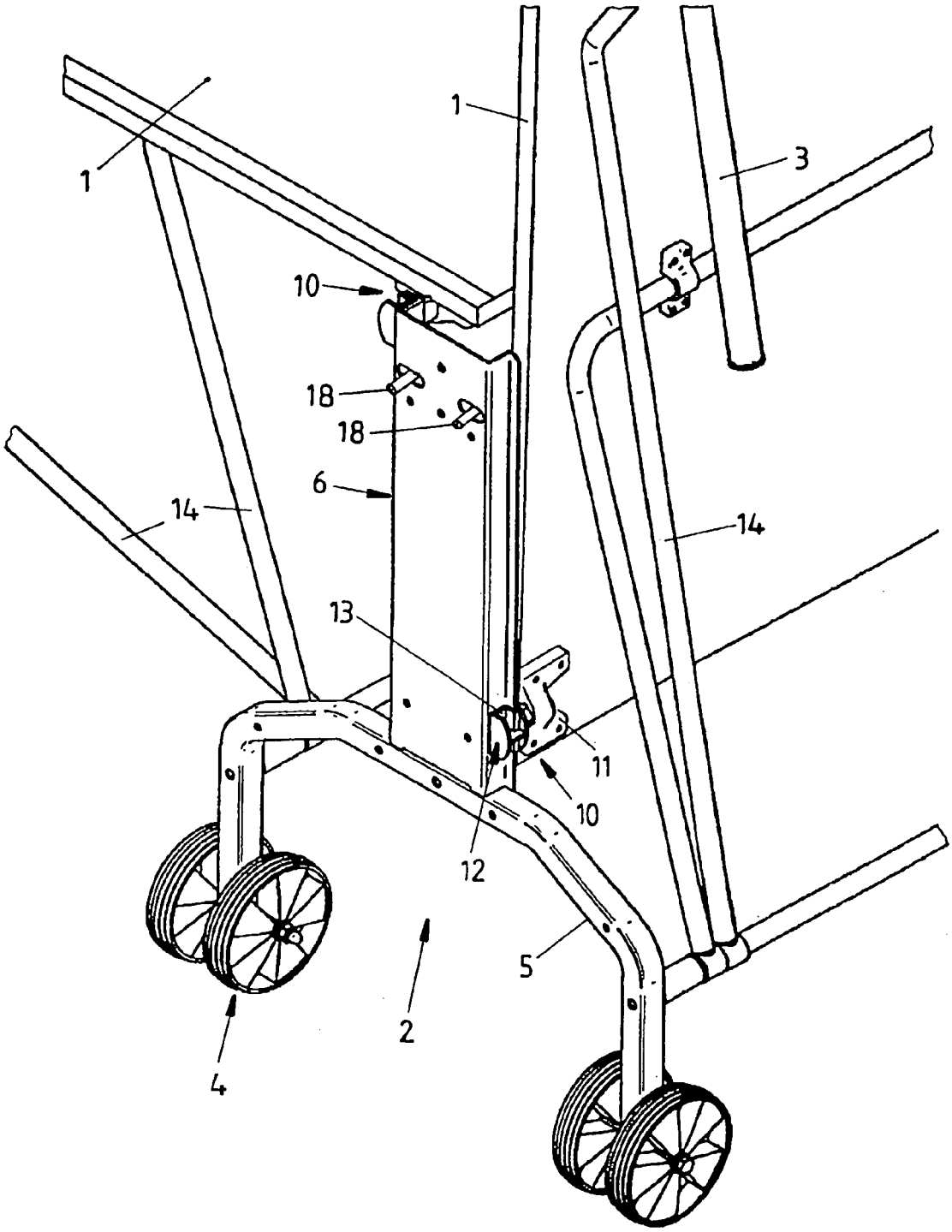
FIG. 2 shows a perspective detailed view of the table tennis table as shown in FIG. 1.

In order to fold one of the playing surface boards 1, for example the playing surface board 1 which is shown on the right in FIG. 1 or in FIG. 2, out of the vertical position into the horizontal position, by applying a force to the upper end of the playing surface board 1 to the right in FIG. 1 the guide part 12 of the mounting unit 10 is moved up on the outer leg 8 of the vertical brace 6. If the guide part 12 has reached the upper edge area of the vertical brace 6, the playing surface board 1 is in the horizontal position of use.

Figure 4:
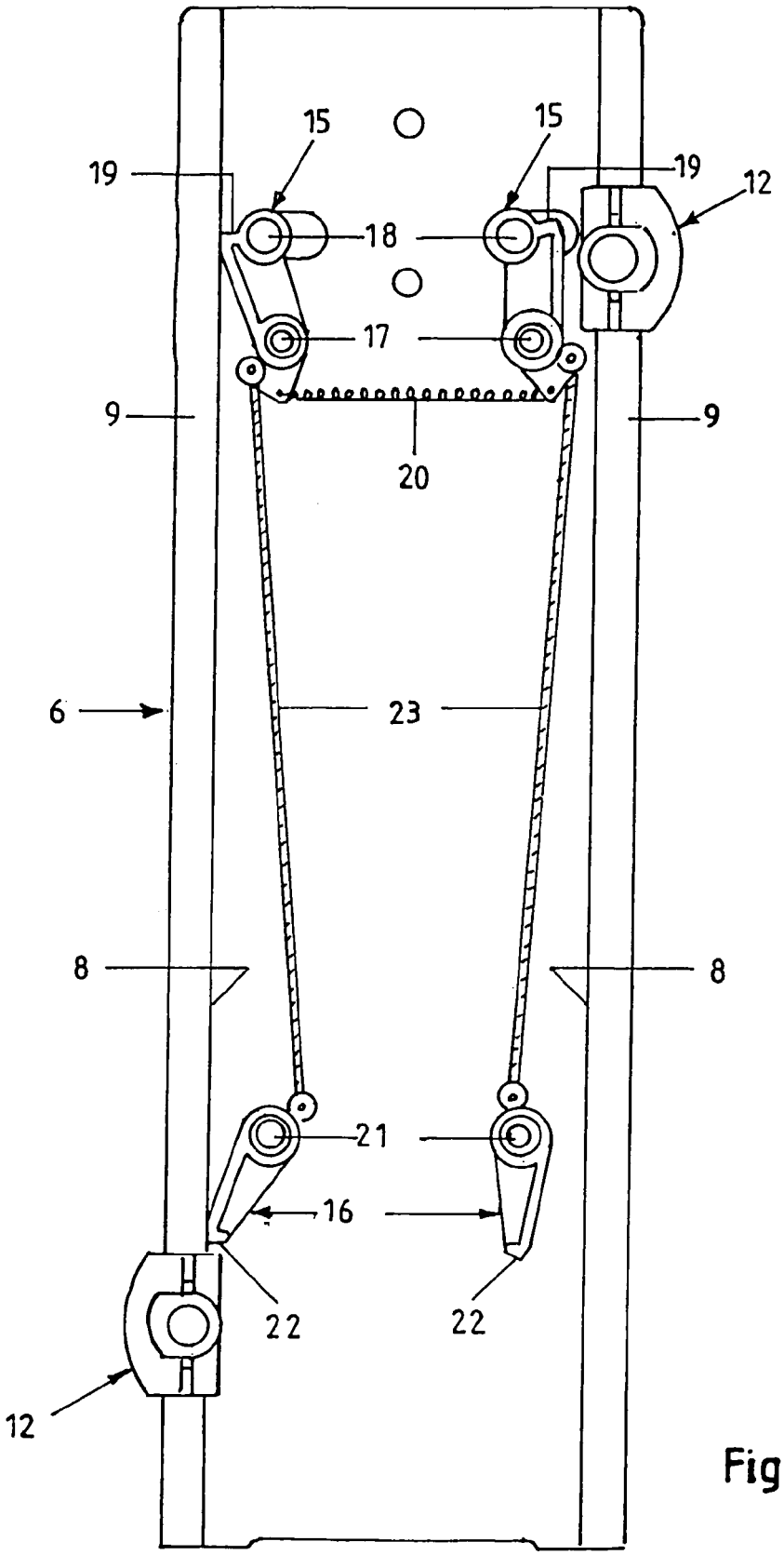
FIG. 4 shows a schematic side view from the inside to the vertical brace of the table as shown in FIG. 1.

FIG. 4 schematically shows the inside of one of the two vertical braces 6. FIG. 4 furthermore shows the two guide parts 12 which can slide up and down on the two outer legs 8 and on the turned edge 9 of these outer legs 8. Furthermore, FIG. 4 shows that on the vertical brace 6 there are two upper and two lower safety levers 15, 16. The safety levers 15, 16 are used to prevent unwanted movement of the guide parts 12 up or down.

The two upper safety levers 15 are attached in the area of one axis 17 of rotation to the vertical brace 6. From the axis 17 of rotation there extends one leg of the upper safety lever 15 upward, this leg having on the end side on the one hand an actuating lever 18 and on the other hand a locking surface 19 which can be placed against or which adjoins the leg 8 of the vertical brace 6. For the safety lever 15 which is the left one in FIG. 4, the locking surface 19 adjoins the leg 8, conversely for the safety lever which is top right in FIG. 4 the locking surface 19 is swivelled away from the leg 8 so that the guide part 12 which is attached to the right leg 8 and the edge 9 which is connected to it can slide down past the locking surface 19. Conversely, one guide part 12 which is attached above the left upper safety lever 15 cannot be moved down as a result of the locking surface 19 which is in contact with the outer leg 8.

To release the movement of the guide part 12 down the user can move the actuating lever 18 to the inside, which lever, as is apparent from FIG. 2, projects through openings to the outside in the vertical brace 6 and thus can be grasped from the outside. For example, the safety lever 15 which is top left in FIG. 4 could be swivelled around the axis 17 of rotation a distance clockwise by moving the actuating lever 18 to the right such that the locking surface 19 is swivelled away from the leg 9, as is shown in FIG. 4, top right, for the upper right safety lever 15.

FIG. 4 furthermore shows that the two lower safety levers 15 are connected to one another by means of a spring 20. This spring 20 engages a second leg of the safety lever 15 which extends down from the axis 17 of rotation. The springs 20 cause the two second lower legs of the safety levers 15 to be pulled toward one another after the actuating lever 18 is released by the user. By pulling the lower legs toward one another in this way, at the same time the upper legs of the safety levers 15 are moved to the outside away from one another. In this way then the locking surfaces 19 are moved into contact with the outer legs 8. By providing the springs 20 the movement of the guide part 12 down is automatically prevented by the locking surface 19 which adjoins the outer leg 8. This blocking by the locking surface 19 can be purposely cancelled by the user by moving the actuating lever or levers 18 to the inside. The locking surfaces 19 are attached to the safety levers 15 such that even by the additional action of a force on the guide parts 12 for example by applying pressure to the playing surface boards 1, the locking surfaces cannot swivel to the inside, because the guide parts 12 rest on the locking surfaces 19 in the area which lies farther to the outside or nearer on the legs 8 than the axes 17 of rotation of the safety levers 15, which axes are located somewhat farther down. In this way, using simple means the upper positions of the guide parts 12 and thus of the playing surface boards 1 are reliably secured.

FIG. 4 furthermore shows that the lower safety levers 16 are likewise attached in the area of the axes 21 of rotation to the vertical brace 6. From these axes 21 of rotation one leg of the safety lever 16 at a time extends down and ends in the locking surface 22. The locking surface 22 on the left side of FIG. 4 in turn adjoins the outer leg 8 and thus prevents movement of the guide part 12 up in FIG. 4. The locking surface 22 on the lower right side in FIG. 4 is swivelled away from the outer leg 8 so that the guide part 12 which is located underneath the safety lever 16 could be guided upward past the safety lever 16. The locking surfaces 22 and the safety lever 16, like the locking surfaces 19 of the safety levers 15, are located farther to the outside or nearer on the legs 8 than the corresponding axes 21 of rotation so that by the action of force on the guide parts 12 they cannot be moved up at the locking surfaces 22 which adjoin the legs 8.

FIG. 4 furthermore shows that the upper and lower safety levers 15, 16 which are located on one side are connected to one another by a transmission rod 23. This transmission rod 23 engages the lower leg of the upper safety lever 15 or the upper leg of the lower safety lever 16, which upper leg extends up from the axis 21 of rotation. The transmission rod 23 ensures that by moving the actuating level 18 not only the corresponding upper left or right safety lever 15, but also the lower safety lever 16 which is connected to it via the transmission rod 23 is swivelled according to the movement of the actuating lever 18. For example, by moving the actuating lever 18 of the upper left safety lever 15 to the right in FIG. 4 the attachment point of the transmission rod 23 to the safety lever 15 could be moved up. In this way however the attachment point of the transmission rod 23 to the lower left safety lever 16 is also moved up and to the left in FIG. 4, by which the lower safety lever 16 is swivelled counter-clockwise so that the locking surface 22 is moved away from the leg 8. The end position of this swivelling motion is apparent on the right side in FIG. 4, where both the actuating lever 18 of the top right safety lever 15 is moved entirely to the inside or to the left, and also the two locking surfaces 19, 22 of the right safety levers 15, 16 are swivelled away from the leg 8.

By actuating the actuating lever 18 thus both the upper and also the lower corresponding safety lever 15, 16 which is located on this side can be swivelled such that movement of the guide part 12 is released.

The actuating levers 18 which are opposite one another are not connected to one another so that for folding one playing surface board the actuating levers 18 which are opposite one another must be actuating in succession.

Figure 5:
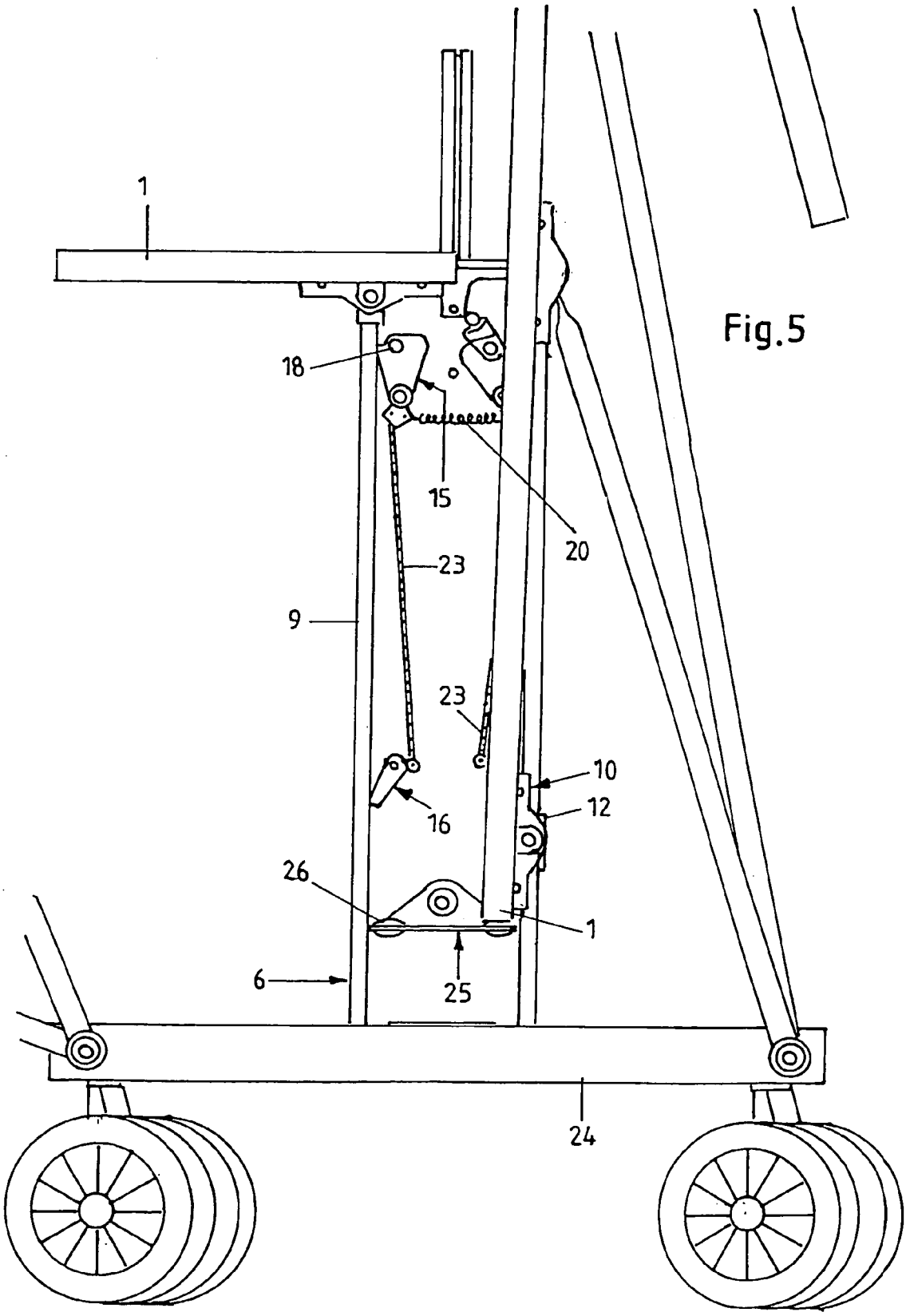
FIG. 5 shows a schematic side view from the inside to one vertical brace and parts of the construction of another embodiment of a table tennis table as claimed in the invention.

FIG. 5 shows another embodiment of the table tennis table as claimed in the invention. In this further embodiment, instead of a connecting brace which extends a distance upward and then runs horizontally there is a connecting brace 24 which extends only horizontally. This connecting brace 24 is attached directly to the vertical brace 6 which extends upward from it. Furthermore, FIG. 5 also shows at least in part the safety levers 15, 16 and the transmission rod 23 which connects them. The upper safety lever 15 is shaped somewhat differently than the one shown in FIG. 4, but functionally it has the same structure.

In addition to the elements which are shown in FIG. 4, the embodiment shown in FIG. 5 has a support means 25 which is made as a support angle, which extends to the inside, which is attached to the vertical brace 6 in the lower area, and which has on its top two support cushions 26 for supporting the inner end faces of the playing surface boards 1. The support angle results in that when a force is applied to the playing surface board 1 which is in the vertical position (see right side in FIG. 5) from overhead, it is not the guide mechanism, i.e. especially the mounting units 10 with the guide part 12, but the support angle which accommodates this force so that the guide mechanism cannot be damaged. This support angle can of course also be used in the embodiments as shown in FIGS. 1 to 4 as claimed in the invention.

What is claimed is:

1. A table for playing table tennis, comprising a first playing surface having a first side, a second side, a first end and a second end, a first vertical support brace attached to said first playing surface, a second playing surface having a first side, a second side, a first end and a second end, a second vertical support brace attached to said second playing surface, the first playing surface second end placed proximate to said second playing surface second end, a vertical brace next to said first playing surface and said second playing surface, said vertical brace having a middle leg, a first outer leg and a second outer leg, a first mounting unit having a guide part attached to and extending from said first playing surface, said first guide part contacting and movable along said first outer leg, a second mounting unit having a guide part attached to and extending from said second playing surface, said second guide part contacting and movable along said second outer leg.

2. The table as claimed in claim 1, wherein the vertical brace has a substantially U-shaped or C-shaped cross section.

3. The table as claimed in claim 2, wherein the cross section of the vertical brace is a U-shaped leg with said outer legs extending substantially perpendicular from said middle leg, and the outer legs on their ends facing away from the U-shaped leg have a turned edge.

4. The table as claimed in claim 3, wherein the turned edge extends perpendicularlly away from the outer legs.

5. The table as claimed in claim 4, wherein the turned edges extend from the outer legs away from one another or toward one another.

6. The table as claimed in claim 3, wherein each guide part has at least one contact section which adjoins one of the side surfaces of one of the outer legs.

7. The table as claimed in claim 3, wherein each guide part has two contact sections which adjoin the opposing side surfaces of one of the outer legs.

8. The table as claimed in claim 6, wherein each guide part encompasses the turned edge of the corresponding outer leg.

9. The table as claimed in claim 6, wherein one guide part of one the mounting units at a time engages each of the outer legs of the two vertical braces.

10. The table as claimed in claim 1, wherein the mounting units each comprise one attachment part which is mounted on the bottom of one of the playing surface boards.

11. The table as claimed in claim 1, wherein the vertical brace is mounted on a connecting brace which connects roller base units to one another.

12. The table as claimed in claim 1, wherein the table on the inside of each of the vertical braces in its lower area has a support means on which the inside end faces of the playing surface boards can be supported in their vertical positions, the support means being made preferably as a support angle which is attached to the vertical brace.

13. The table as claimed in claim 1, further comprising, two upper and two lower safety levers pivotally located on the vertical brace and having locking surfaces which in a first position of the safety levers enable the guide parts to be moved up and/or down and which in a second position of the safety levers prevent the guide parts from moving up and/or down.

14. The table as claimed in claim 13, wherein on the upper safety levers there are actuating levers for swivelling the safety levers, the upper safety levers and the lower safety levers being connected to one another so that swivelling motion of the upper safety levers causes a corresponding swivelling motion of other lower safety levers, the connection between the respective upper and lower safety levers taking place via a transmission rod which is aligned essentially vertically.

15. The table as claimed in claim 13, wherein the upper safety levers are connected to one another on each of the vertical braces by a spring means so that when the actuating lever is not actuated the spring means swivels the upper safety means into the position in which the locking surfaces prevent the guide parts from moving up and down.

16. The table of claim 1, wherein said first outer leg and said second outer leg are perpendicular to said middle leg.

17. A table for playing table tennis comprising:

two playing surface boards and mounting units which are attached to the playing surface boards and which comprise guide parts, a lower frame with vertical braces which are used as support elements and lie opposite one another over the width of the table tennis table in a middle area of the table tennis table, and vertical guide means, being embodied on the vertical braces, on which said guide parts can be moved up and down, so that in this way the playing surface boards can be transferred from a first position in which the playing surface boards are vertically aligned and the guide parts are located in a lower position, into a second position in which the playing surface boards are horizontally aligned and the guide parts are located in an upper position, each of said vertical braces comprise at least one U-shaped portion with a U-shaped horizontal cross section comprising an inner leg and two outer legs extending perpendicular from the inner leg, each of said guide parts interacts with one of said outer legs of said at least one U-shaped portion and has a contact section which contacts the outside surface of said outer leg.

18. A table for playing table tennis comprising:

two playing surface boards and mounting units which are attached to the playing surface boards and which comprise guide parts, a lower frame with vertical braces which are used as support elements and lie opposite one another over the width of the table tennis table in a middle area of the table tennis table, and vertical guide means, being embodied on the vertical braces, on which said guide parts can be moved up and down, so that in this way the playing surface boards can be transferred from a first position in which the playing surface boards are vertically aligned and the guide parts are located in a lower position, into a second position in which the playing surface boards are horizontally aligned and the guide parts are located in an upper position, each of said vertical braces comprise at least one U-shaped portion with a U-shaped horizontal cross section comprising an inner leg and two outer legs extending perpendicular from the inner leg, each of said guide parts interacts with one of said outer legs of said at least one U-shaped portion, each of said guide parts has a first contact section which contacts the outside surface of one of said outer legs and a second contact section which contacts the inside surface of one of said outer legs.

19. A table for playing table tennis comprising:

two playing surface boards and mounting units which are attached to the playing surface boards and which comprise guide parts, a lower frame with vertical braces which are used as support elements and lie opposite one another over the width of the table tennis table in a middle area of the table tennis table, and vertical guide means, being embodied on the vertical braces, on which said guide parts can be moved up and down, so that in this way the playing surface boards can be transferred from a first position in which the playing surface boards are vertically aligned and the guide parts are located in a lower position, into a second position in which the playing surface boards are horizontally aligned and the guide parts are located in an upper position, each of said vertical braces comprise at least one U-shaped portion with a U-shaped horizontal cross section comprising an inner leg and two outer legs extending perpendicular from the inner leg, each of said guide parts interacts with one of said outer legs of said at least one U-shaped portion, each of said guide parts has a first contact section which contacts the outside surface of one of said outer legs and a second contact section which contacts the inside surface of one of said outer legs, said U-shaped horizontal cross section of the at least one U-shaped portion does not change in the vertical direction.

* * * * *

US006990910C1

(12) INTER PARTES REEXAMINATION CERTIFICATE (0195th)

United States Patent

Kettler et al.

(10) Number: US 6,990,910 C1

(45) Certificate Issued: Oct. 12, 2010

(54) TABLE TENNIS TABLE

(75) Inventors: Joachim Kettler, Ense (DE); Heinz Kettler, Ense (DE); Reinhard Rocholl, Soest (DE)

(73) Assignee: Heinz Kettler GmbH & Co. KG, Ense (DE)

Reexamination Request:
No. 95/001,090, Oct. 16, 2008

Reexamination Certificate for:

| | |
|---|---|
| Patent No.: | **6,990,910** |
| Issued: | **Jan. 31, 2006** |
| Appl. No.: | **10/484,445** |
| Filed: | **Jan. 29, 2004** |

(22) PCT Filed: Jun. 17, 2002

(86) PCT No.: PCT/DE02/02198

§ 371 (c)(1),
(2), (4) Date: Jan. 29, 2004

(87) PCT Pub. No.: WO03/026461

PCT Pub. Date: Apr. 3, 2003

(51) Int. Cl.
*A47B 3/00* (2006.01)

(52) U.S. Cl. ..... 108/115; 108/167

(58) Field of Classification Search ..... None
See application file for complete search history.

(56) References Cited

U.S. PATENT DOCUMENTS

| | | | |
|---|---|---|---|
| 6,425,835 | B1 | 7/2002 | Kettler et al. |
| 6,990,910 | B2 | 1/2007 | Kettler et al. |

FOREIGN PATENT DOCUMENTS

| | | |
|---|---|---|
| AU | 69-996 B1 | 4/1981 |
| FR | 2729302 | 7/1996 |
| GB | 1489795 | 10/1977 |

OTHER PUBLICATIONS

Harvard Sports Catalog 1989, page with International Competition Table.
Harvard Sports Catalog 1990, page with International Competition Table.
Harvard Sports Catalog 1995, page with International Competition Table.
International Competition Table Manual.
Harvard Sports Catalog 1985, page with Bronze Specter Table.
Harvard Sports Catalog 1984, page with Bronze Specter Table.
Harvard Sports sales sheet with Bronze Specter Table, 1984–1985.
DMI Table Assembly Instructions, Dated Mar. 4, 2001.

*Primary Examiner*—Aaron J. Lewis

(57) ABSTRACT

The disclosure relates to a table tennis table comprising a lower frame and two playing surface boards. Said lower frame comprises vertical struts which are used as carrier elements and are arranged opposite each other along the width of the table tennis table, in the central region of the same, and vertical guiding structure on which guiding elements pertaining to fixing units applied to the playing surface boards can be moved upwards and downwards, in such a way that the playing surface boars can thus be transferred from a first position, in which the playing surface boards are vertically oriented and the guiding elements are arranged in a lower position, to a second position, in which the playing surface boards are horizontally oriented and the guiding elements are arranged in an upper position, the guiding structure being embodied on the vertical struts used as carrier elements.

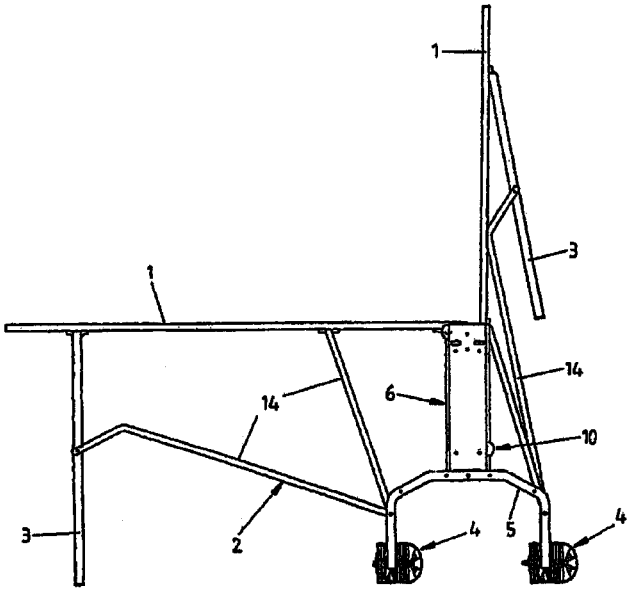

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 17-19 is confirmed.

Claims 1 and 11 are cancelled.

Claims 2, 10, 12, 13 and 16 are determined to be patentable as amended.

Claims 3-9, dependent on an amended claim, are determined to be patentable.

New claim 20 is added and determined to be patentable.

Claims 14 and 15 were not reexamined.

2. [The table as claimed in claim 1] *A table for playing table tennis, comprising:*

*a first playing surface having a first side, a second side, a first end and a second end,*

*a first vertical support brace attached to said first playing surface,*

*a second playing surface having a first side, a second side, a first end and a second end,*

*a second vertical support brace attached to said second playing surface,*

*the first playing surface second end placed proximate to said second playing surface second end,*

*a vertical brace next to said first playing surface and said second playing surface, said vertical brace having a middle leg, a first outer leg and a second outer leg,*

*a first mounting unit having a guide part attached to and extending from said first playing surface, said first guide part contacting and movable along said first outer leg,*

*a second mounting unit having a guide part attached to and extending from said second playing surface, said second guide part contacting and movable along said second outer leg*, wherein the vertical brace has a substantially U-shaped or C-shaped cross section.

10. [The table as claimed in claim 1] *A table for playing table tennis, comprising:*

*a first playing surface having a first side, a second side, a first end and a second end,*

*a first vertical support brace attached to said first playing surface,*

*a second playing surface having a first side, a second side, a first end and a second end,*

*a second vertical support brace attached to said second playing surface,*

*the first playing surface second end placed proximate to said second playing surface second end,*

*a vertical brace next to said first playing surface and said second playing surface, said vertical brace having a middle leg, a first outer leg and a second outer leg,*

*a first mounting unit having a guide part attached to and extending from said first playing surface, said first guide part contacting and movable along said first outer leg,*

*a second mounting unit having a guide part attached to and extending from said second playing surface, said second guide part contacting and movable along said second outer leg*, wherein the mounting units each comprise one attachment part which is mounted on the bottom of one of the playing surface boards.

12. [The table as claimed in claim 1] *A table for playing table tennis, comprising:*

*a first playing surface having a first side, a second side, a first end and a second end,*

*a first vertical support brace attached to said first playing surface,*

*a second playing surface having a first side, a second side, a first end and a second end,*

*a second vertical support brace attached to said second playing surface,*

*the first playing surface second end placed proximate to said second playing surface second end,*

*a vertical brace next to said first playing surface and said second playing surface, said vertical brace having a middle leg, a first outer leg and a second outer leg,*

*a first mounting unit having a guide part attached to and extending from said first playing surface, said first guide part contacting and movable along said first outer leg,*

*a second mounting unit having a guide part attached to and extending from said second playing surface, said second guide part contacting and movable along said second outer leg*, wherein the table on the inside of each of the vertical braces in its lower area has a support means on which the inside end faces of the playing surface boards can be supported in their vertical positions, the support means being made preferably as a support angle which is attached to the vertical brace.

13. [The table as claimed in claim 1, further comprising,] *A table for playing table tennis, comprising:*

*a first playing surface having a first side, a second side, a first end and a second end,*

*a first vertical support brace attached to said first playing surface,*

*a second playing surface having a first side, a second side, a first end and a second end,*

*a second vertical support brace attached to said second playing surface,*

*the first playing surface second end placed proximate to said second playing surface second end,*

*a vertical brace next to said first playing surface and said second playing surface, said vertical brace having a middle leg, a first outer leg and a second outer leg,*

*a first mounting unit having a guide part attached to and extending from said first playing surface, said first guide part contacting and movable along said first outer leg,*

*a second mounting unit having a guide part attached to and extending from said second playing surface, said second guide part contacting and movable along said second outer leg,* two upper and two lower safety levers pivotally located on the vertical brace and having locking surfaces which is a first position of the safety levers enable the guide parts to be moved up and/or down and which in a second position of the safety levers prevent the guide parts from moving up and/or down.

16. [The table of claim 1] *A table for playing table tennis, comprising:*

*a first playing surface having a first side, a second side, a first end and a second end,*

*a first vertical support brace attached to said first playing surface,*

*a second playing surface having a first side, a second side, a first end and a second end,*

*a second vertical support brace attached to said second playing surface,*

*the first playing surface second end placed proximate to said second playing surface second end,*

*a vertical brace next to said first playing surface and said second playing surface, said vertical brace having a middle leg, a first outer leg and a second outer leg,*

*a first mounting unit having a guide part attached to and extending from said first playing surface, said first guide part contacting and movable along said first outer leg,*

*a second mounting unit having a guide part attached to and extending from said second playing surface, said second guide part contacting and movable along said second outer leg*, wherein said first outer leg and said second outer leg are perpendicular to said middle leg.

*20. A table for playing table tennis, comprising:*

*a first playing surface having a first side, a second side, a first end and a second end,*

*a first vertical support brace attached to said first playing surface,*

*a second playing surface having a first side, a second side, a first end and a second end,*

*a second vertical support brace attached to said second playing surface,*

*the first playing surface second end placed proximate to said second playing surface second end,*

*a vertical brace next to said first playing surface and said second playing surface, said vertical brace having a middle leg, a first outer leg and a second outer leg,*

*a first mounting unit having a guide part attached to and extending from said first playing surface, said first guide part contacting and movable along said first outer leg,*

*a second mounting unit having a guide part attached to and extending from said second playing surface, said second guide part contacting and movable along said second outer leg, wherein the table on the inside of each of the vertical braces in its lower area has a support means on which the inside end faces of the playing surface boards can be supported in their vertical positions, the support means being made preferably as a support angle which is attached to the vertical brace.*

* * * * *